US006702394B2

(12) United States Patent
Boucherie

(10) Patent No.: US 6,702,394 B2
(45) Date of Patent: Mar. 9, 2004

(54) METHOD AND DEVICE OF MELTING TOGETHER FIBER ENDS

(75) Inventor: Bart Gerard Boucherie, Izegem (BE)

(73) Assignee: G. B. Boucherie N.V. (BE)

( * ) Notice: Subject to any disclaimer, the term of this patent is extended or adjusted under 35 U.S.C. 154(b) by 350 days.

(21) Appl. No.: 09/811,819

(22) Filed: Mar. 20, 2001

(65) Prior Publication Data

US 2001/0038237 A1 Nov. 8, 2001

(30) Foreign Application Priority Data

Mar. 21, 2000 (EP) ..... 00105386

(51) Int. Cl.[7] ..... A46B 3/00; A46D 1/00; B29C 35/02

(52) U.S. Cl. ..... 300/21; 300/8; 156/72

(58) Field of Search ..... 300/5, 8, 21; 264/404, 264/237; 156/72, 435, 289, 281, 498, 309.6, 499

(56) References Cited

U.S. PATENT DOCUMENTS 4,968,103 A * 11/1990 McNab et al. ..... 300/21
4,974,908 A * 12/1990 Theodore ..... 300/21
5,033,797 A * 7/1991 Rueb ..... 300/5
5,765,927 A * 6/1998 Lewis, Jr. ..... 300/21
5,964,508 A * 10/1999 Maurer ..... 300/21

FOREIGN PATENT DOCUMENTS

DE 25 39 417 3/1976

OTHER PUBLICATIONS

European Search Report (EP 01 10 6375) dated Aug. 07, 2001.

* cited by examiner

*Primary Examiner*—Robert J. Warden, Sr.
*Assistant Examiner*—Laura C Cole
(74) *Attorney, Agent, or Firm*—Nixon Peabody LLP; Stuart J. Friedman

(57) ABSTRACT

In a method of melting together axial ends of bunched fibers of thermoplastic material, the fiber ends are brought into contact with the heated surface of a stamp. The body of the stamp is heated by controlling an electric current passing through it. In one embodiment the stamp is cooled by a flow of compressed air before the stamp is separated from the fiber ends. In another embodiment, the stamp is separated from the melted fiber ends, heated to a higher temperature to vaporize any residual fiber material, and cooled by exposure to compressed air until it has no more than the temperature for melting the fiber material.

8 Claims, 5 Drawing Sheets

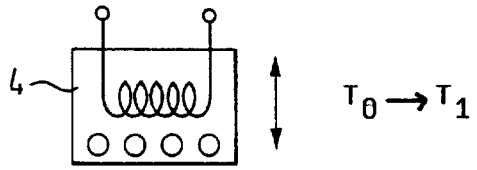
FIG. 1
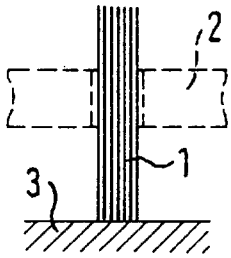
FIG. 2
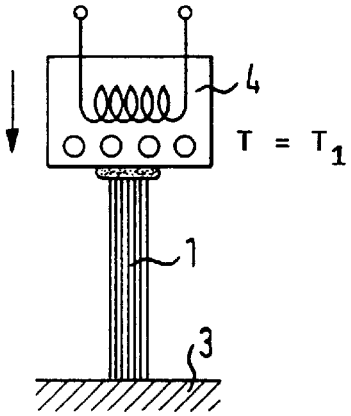
FIG. 3
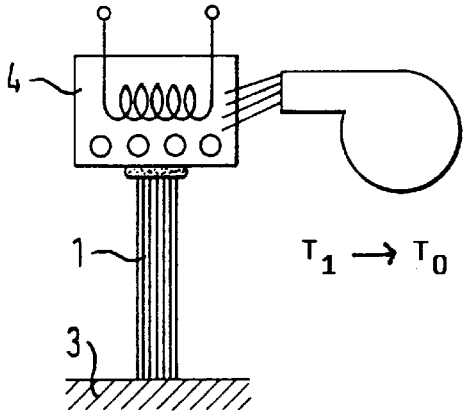
FIG. 4
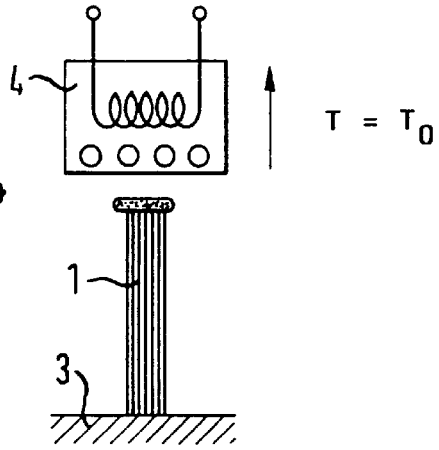

METHOD AND DEVICE OF MELTING TOGETHER FIBER ENDS

FIELD OF THE INVENTION

The invention relates to a method of melting together the axial ends of bunched fibers of thermoplastic material, wherein the fiber ends are brought into contact with a heated surface of a stamp. The invention relates further to a device for attaching tufts of bristles for use in brushes to carrier plates of thermoplastic material. The carrier plates with the tufts of bristles attached thereto are incorporated in brush bodies, in particular for the fabrication of tooth brushes.

BACKGROUND OF THE INVENTION

Several methods are known for the fabrication of brushes. In principle, brush bodies, having an array of holes corresponding to the desired array of bristles, can be provided. The tufts of bristles are then inserted into the holes of the brush body and anchored therein. The anchorage of the tufts of bristles in the brush body by means of anchor platelets or loops requires, however, highly performant and hence expensive machines.

According to an alternative fabrication method for brushes, the tufts of bristles are attached to a carrier plate that then is built into a brush body. The carrier plate can be joined to the brush body by injection-moulding around it or by welding. The carrier plate will be provided with holes according to the desired hole pattern, the utilization ends of the tufts of bristles projecting out of one surface of the carrier plate, and the axial ends of the tufts of bristles to be anchored in the brush protruding slightly out of the opposite side. A heated stamp is pressed against those ends of the tufts of bristles that are to be anchored in the brush body, melting together the ends of the tufts of bristles and possibly deforming them into knobs. During the subsequent separation of the stamp from the melted fiber ends, sticky threads and smearing of the viscous melted synthetic material may occur. Since, furthermore, the ends of the bristles as well as the carrier plate are heated, it is difficult on the one hand to effect the deformation of the bristles necessary for a perfect anchoring, and to prevent on the other hand an unwanted deformation of the carrier plate, all the more since the carrier plate and the bristles usually are made of different synthetic materials.

BRIEF SUMMARY OF THE INVENTION

The invention provides a method of melting together the axial ends of bunched fibers of thermoplastic material, wherein the fiber ends are brought into contact with the heated surface of a stamp. According to the invention, the body of the stamp is heated by passing a controlled electric current through it, enabling extremely rapid and precisely controllable temperature changes of the stamp.

In a first variant of the invention, the fiber ends are brought into contact with a heated surface of a stamp, which then is cooled abruptly. Only after cooling of the surface has occured, the fiber ends are separated from it. In this way, the melted fiber ends can be removed cleanly from the heated surface and show an overall shape that is determined by the geometry of the surface. In this variant the application of a non-stick coating is advantageous.

Like in the first variant, in a second variant according to the invention the fiber ends are first brought into contact with a surface heated to a first temperature. The surface is then separated from the fiber ends while maintaining, however, the temperature of the surface. After that, the surface is heated up to a second, higher temperature in order to vaporize any remainder of the fiber material adhering to the surface. In a final step according to the method, the surface is cooled again to the first temperature. In this variant, the adherence properties of the heated surface with respect to the heated fiber material are uncritical, a non-stick coating being hence unnecessary.

Both variants of the invention are especially suited for the fabrication of arrays of bristles to fabricate brushes. Fibers for the fabrication of brushes mostly consist of a thermoplastic material like polyamide ("nylon"). This material can be deformed easily with the inventive method.

The invention further provides a device for attaching tufts of bristles to carrier plates in order to manufacture brushes, enabling a controllable and well reproducible operation of the stamp upon the ends of the bristles, assuring the desired deformation of the ends of the bristles without any unwanted deformation of the carrier plate. In the device according to the invention, the stamp is heated by an electric current and can be cooled by a flowing cooling agent. The stamp can be heated rapidly and in a specific way by an electric current, especially if, according to the preferred embodiment, it has a low heat capacity, so that it quickly can be cycled through different temperature phases, including cooling by the cooling agent. Since the ends of the bristles are heated only a very short time and instantanously cooled again afterwards, a smearing of the heated bristle material on the carrier plate is avoided. By the same token, the stamp may alternatively be heated to a second, higher temperature after having been withdrawn from the fiber ends in order to vaporize any remainder of the fiber material adhering to the surface. The carrier plate itself is warmed up only slightly since the stamp is heated only for a short time to the temperature needed to melt together the ends of the bristles, and is removed or cooled instantaneously thereafter. Controlling the electric current, particularly via pulse width modulation, allows a good control of the intensity and the duration of the heating process.

Preferably, the stamp comprises a body of electrically conducting material, on which two electrical high-current terminals in the shape of bent-off contact shoes are formed. The body of the stamp has a thin-walled stamp plate that may be strengthened by an angled bordering strip. Suitable materials for the manufacturing of the stamp are metals, having on the one hand sufficent mechanical strength in order to assure the desired low heat capacity needed for a fast change of temperature, and showing on the other hand only a moderate resistivity, so that only an uncritical electric voltage is needed to achieve the electrical heating power. Although, in this case, the required heating currents have values of some hundred Amperes and more, for example 200 Amperes at a voltage of 7 V, such high currents can well be controlled using available semiconductor components. In view of these criteria, stainless steel, titanium and NiCr-containing alloys are suitable materials for the fabrication of the stamp.

In order to cool the stamp, compressed air is preferably used. Due to the low heat capacity of the stamp, only a short time is needed to cool it down by directing compressed air against it, so that cycle times of about one second are feasable.

In the preferred embodiment of the device, a stamp carrier plate is provided with a plurality of stamps forming a group, and the same number of carrier plates is inserted into the corresponding openings of a supporting plate opposite the stamps. Preferably, the stamps are electrically connected in series at the stamp carrier plate, so that the intensity of the heating current does not increase. This measure is expedient especially if the stamp carrier plate together with the stamps is reciprocated with respect to the carrier plates incorporated in the supporting plate, in which case the electrical leads for the heating current have to be moved accordingly. As a consequence, large conductor cross-sections would be disadvantageous.

BRIEF DESCRIPTION OF THE DRAWINGS

Further features and advantages of the invention will become apparent from the following description and from the accompanying drawings to which reference is made. The drawings show:

FIGS. 1 to 4 diagrams illustrating a first variant of the method according to the invention;

DETAILED DESCRIPTION OF THE INVENTION

In the first variant of the method, schematically depicted in FIGS. 1 to 4, fibers 1 of synthetic material are bunched, in particular by means of an apertured plate 2 for example, and set on a stop 3. The stop 3 may be flat or comprise a shaped surface with a profile and can hence be applied in the known way to give the bristles an overall contour by shifting them axially. The free fiber ends are situated opposite a stamp 4 that has a solid body and can be heated by means of an electric current passing through the body. The stamp 4 may have any form, in particular one showing a shaped surface. The stamp 4 is thin-walled and has a low heat capacity. Hence, it can be heated very rapidly using a resistance heating and cooled again equally rapidly with the help of a flowing cooling agent.

In a first step the stamp 4 is heated to a temperature $T_1$. In a second step the stamp 4 is pressed onto the fiber ends, as shown in FIGS. 1 and 2, melting together and shaping the fiber ends. In a third step, FIG. 3, the stamp 4 is then cooled quickly by compressed air directed against it. Only then, in a fourth step, the stamp is separated from the now melted together and cleanly shaped fiber ends.

In the described embodiment of the device, it serves for the fabrication of tooth brushes, wherein a carrier plate, comprising tufts of bristles, is inserted into a brush head and welded to it. Details of such a device can be taken from the EP 0 972 464 A1 and the EP 0 972 465 A1.

Figure 5:
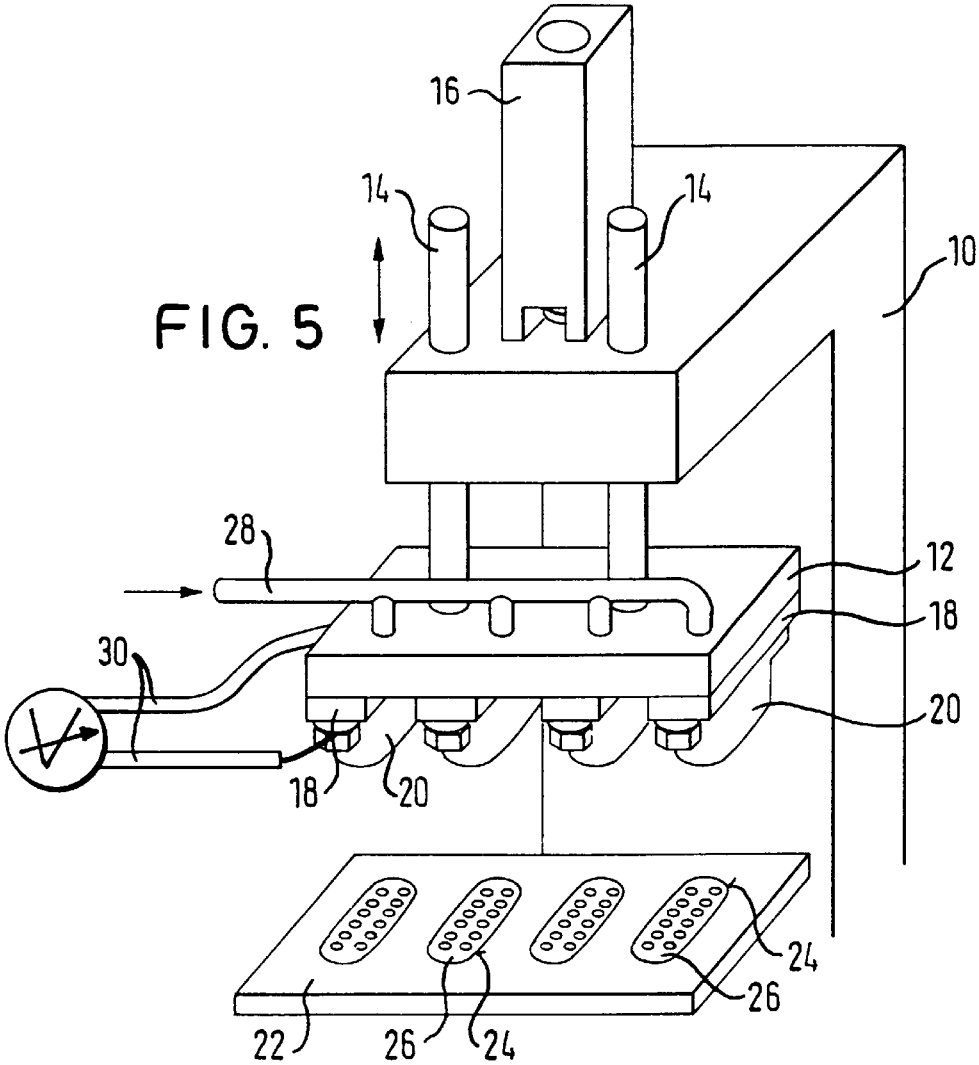
FIG. 5 a schematic perspective view of the device.

A mount 10 (FIG. 5) is provided with a stamp carrier plate 12 that can be reciprocated vertically by means of guide rods 14, the actuation being assured by a pneumatic cylinder 16. To the bottom side of the carrier plate 12 four support bases 18 are attached, carrying each a heatable stamp 20 directed downwards. Below the carrier plate 12, spaced from and parallel to it, is provided a supporting plate 22 having four openings 24 opposite to the stamps 20. A carrier plate 26 made of synthetic material, comprising an array of holes corresponding to the desired array of bristles, is insertable into each of these openings 24.

Via a compressed-air piping 28 branching at the stamp carrier plate 12, the device can be supplied with blasts of compressed air directed against the stamps 20. Furthermore, two flexible high-current cables 30, able to carry an electric current controlled by pulse width modulation, are connected to the stamp carrier plate 12.

Figure 6:
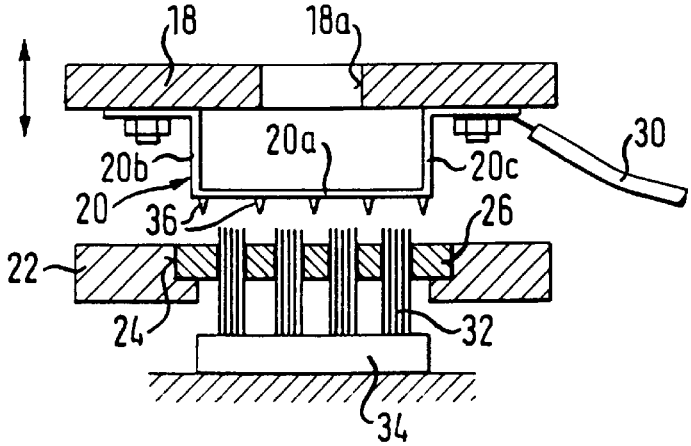
FIG. 6 an enlarged sectional view of a part of the device.

FIG. 6 shows details of a single stamp of the device. This stamp 20 whose structure is better understood from FIG. 5 consists of a metallic body, especially of stainless steel, with a thin-wall stamp plate 20*a* and two bent-off high-current terminals in the form of right-angled contact shoes 20*b*, 20*c* formed thereon. These contact shoes 20*b*, 20*c* in addition serve the attachment of the stamp 20 to the support bases 18, which in turn are employed for electrically connecting the four stamps 20. As can be seen from FIG. 6, the current cables 30 are each directly connected to a cable shoe. The support bases 18 are provided with openings 18*a* being connected through the stamp carrier plate 12 to the compressed-air piping 28 and directing the compressed-air flow against the stamp plate 20*a*.

As further can be seen from FIG. 6, the carrier plate 26 is inserted into the opening 24 of the supporting plate 22 in such a way that its circumferential border is held in place by the boundary of the opening 24. The tufts of bristles 32 inserted into the holes of the carrier plate project 2 to 3 millimeters out of the side of the carrier plate 26 facing the stamp 20 and are propped at the opposite side at a push plate or stop 34. This stop can either be flat or comprise a shaped surface that in addition can be used to give rise to a profile of the tufts of bristles by axially shifting the individual bristles within a single tuft. The surface of the stamp 20 facing the carrier plate is provided with sharp projections 36, whose tips point towards the area of the carrier plate surrounding the holes and hence the tufts of bristles. The surface of the stamp facing the carrier plate further is provided with a non-stick coating.

Figure 7:
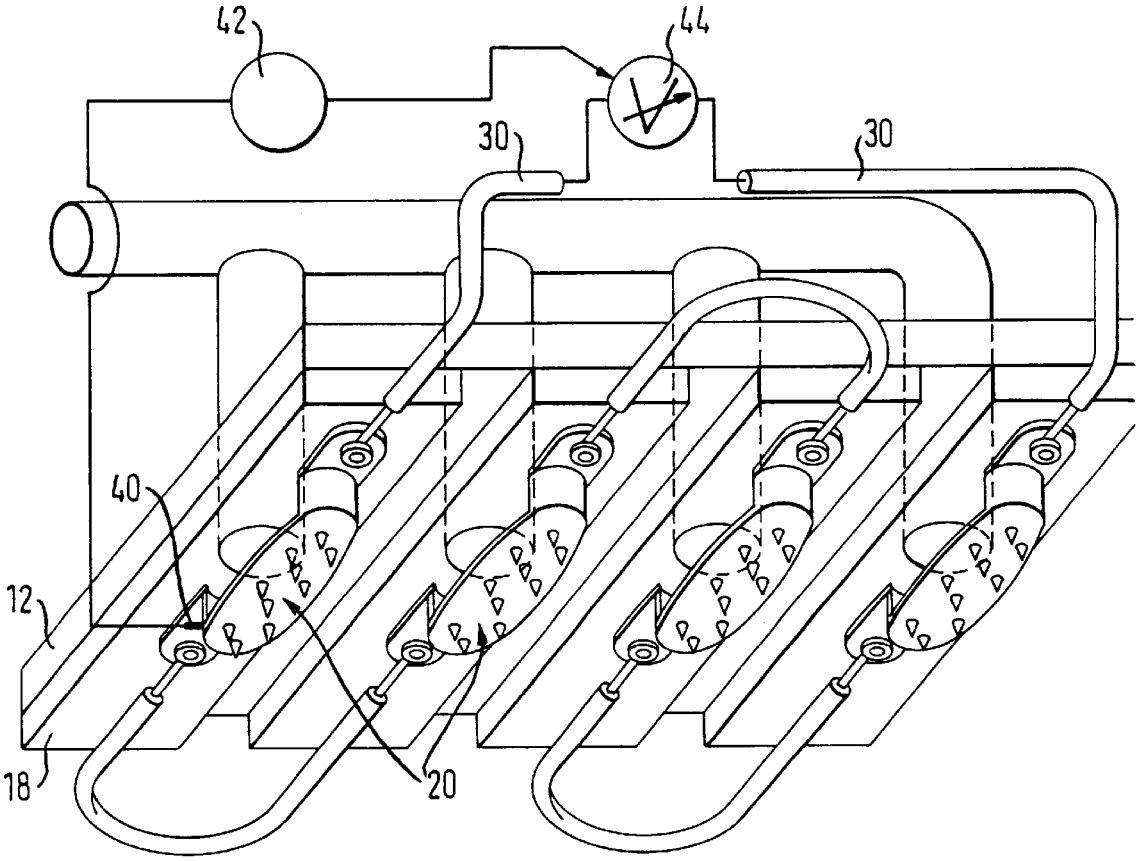
FIG. 7 an enlarged perspective view of a part of the device.

As is apparent from FIG. 7, the four stamps 20 at the stamp carrier plate 12 are electrically connected in series. The connection of the stamps can be realised by individual cable sections or equally by an appropriate design of the support bases 18.

Figure 8:
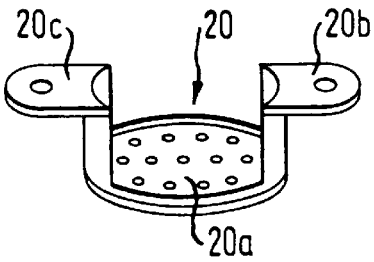
FIG. 8 a perspective view in detail of a stamp of the device.

From the representation of the FIG. 8 it is apparent that the stamp is a thin-wall member that is given a high inherent stability by suitable roundings, formed-on ledges, a bent-up circumferential border and the angled structure of the contact shoes.

As further is apparent from FIG. 7, at least one of the stamps 20, though preferredly each stamp, is associated with a temperature probe 40. The one or each of the temperature probes 40 is connected to a controller 42 driving an electric current supply 44, to the output terminals of which are connected the current cables 30. The current supply 44 preferably operates with pulse width modulation.

In a typical embodiment of the device, the body of each stamp 20 is made of stainless steel. The wall thickness near the stamp plate 20*a* is only a fraction of a millimeter. With a length of the stamp plate of about 20 millimeters and a width of about 10 millimeters, there results a heating power of about 1400 W, corresponding to a current of 200 Amperes at 7 V. In this case, the body of the stamp has such a low heat capacity that the heating/cooling-cycle achievable is of the order of one second. The fast cooling is a consequence of the controlled blast of compressed air alone, being directed against the stamp plate.

Figure 9:
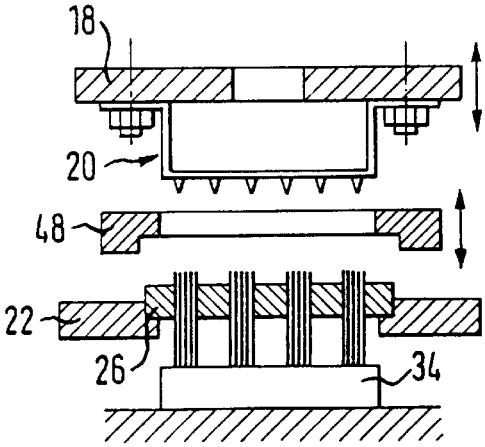
FIG. 9 a sectional view, showing a variant of the embodiment shown in FIG. 2.

In the embodiment shown in FIG. 9, in addition to the supporting plate 22 the carrier plate 26 is overlapped by a movable carrier ring 48. The carrier ring 48 is provided with a through opening for the passage of the stamp 20. The carrier ring 48 ameliorates the support at the circumferential border of the carrier plate 26 to prevent it from a deformation effected by the heated stamp 20. With this embodiment of the device an excellent dimensional accuracy of the carrier plate 26 is assured, resulting in a clean joining with the brush head during the subsequent welding.

Figure 10:
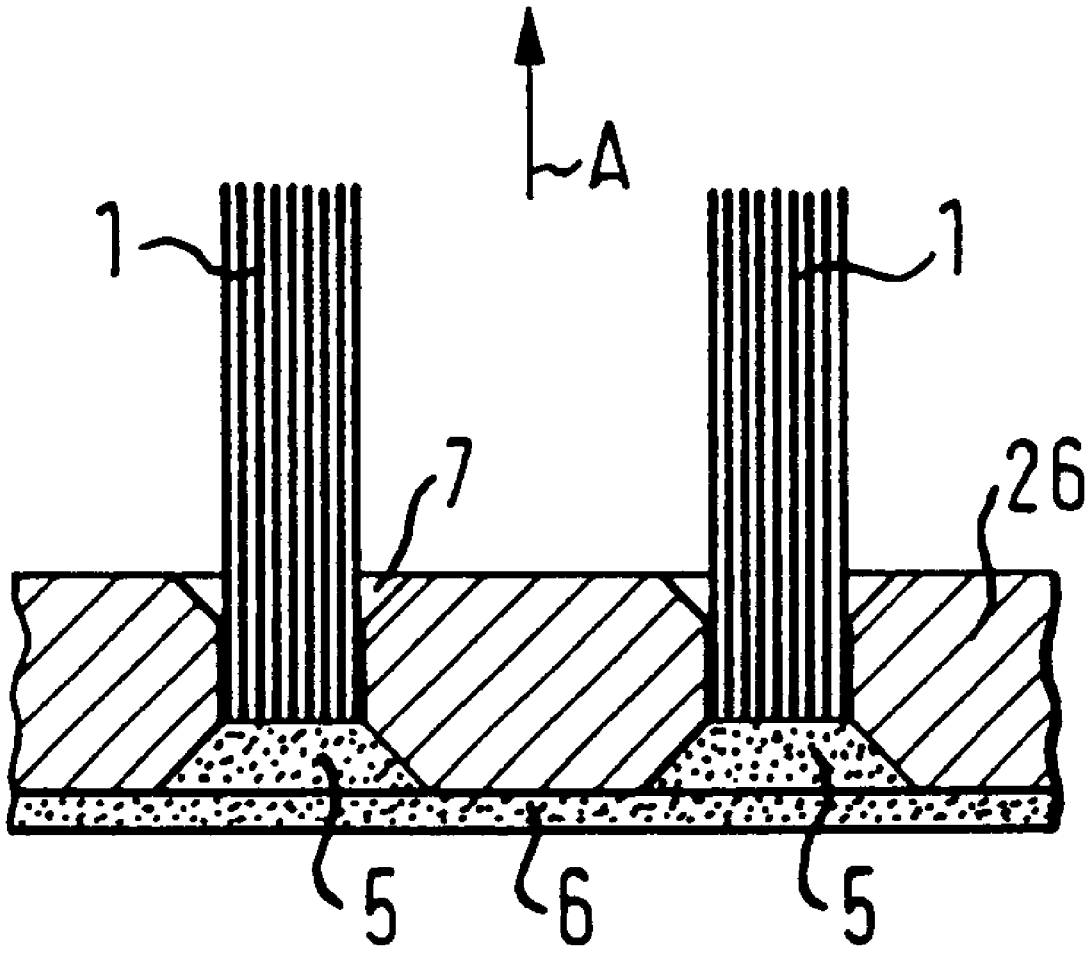
FIG. 10 a partial section of another embodiment.

In the embodiment shown in FIG. 10, the through holes are enlarged on the side of the fiber ends to be melted together, the enlargements being cone-shaped in particular. Pressing the heated surface of the stamp on the plasticized mass of the fiber ends melted together, the mass is pressed into these enlargements resulting in frustum-shaped knobs at the melted fiber ends, that are referenced 5 in FIG. 10. Due to these knobs, the "pull-out force", i.e. the tensile force in the direction "A" in FIG. 10 at which a tuft releases from the carrier plate 26 is increased strongly. An additional enhancement is achieved in that at least part of the plasticized mass is transformed into a continuous layer by pressing the heated stamp onto it, as indicated at 6 in FIG. 10. To facilitate the inserting of the tufts of fibers 1 into the through holes of the carrier plate 26, these through holes are enlarged on the other side of the carrier plate 26 too, as indicated at 7 in FIG. 10.

The second variant of the method as depicted schematically in FIGS. 11 to 15 starts out from the same disposition as the first variant of the invention (FIGS. 1 to 4). Identical parts are indicated by the same reference numerals.

Figure 11:
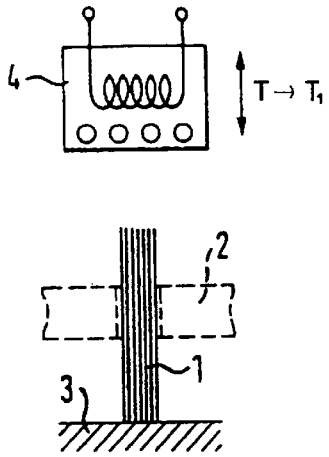
FIGS. 11–15 diagrams illustrating a second variant of the method according to the invention.
Figure 12:
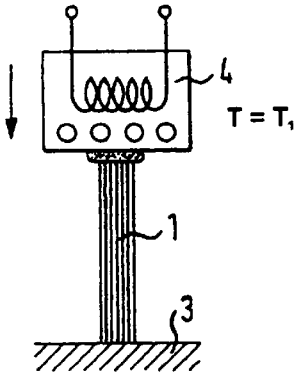
Figure 13:
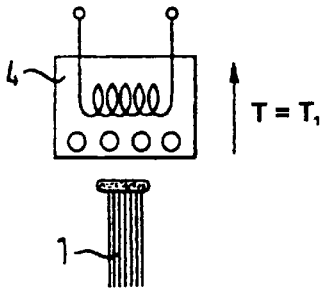
Figure 14:
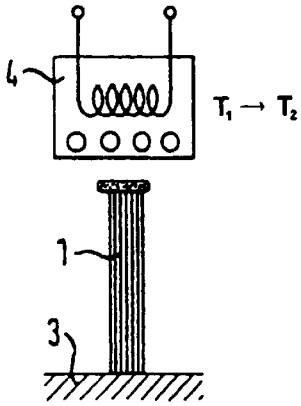
Figure 15:
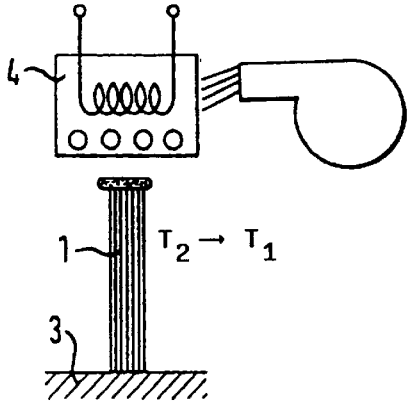

The first two steps of the second variant of the method correspond to the first two steps of the first variant. The stamp 4 is heated to a first temperatuer $T_1$ and pressed onto the fiber ends, as shown in FIGS. 11 and 12. In a third step the stamp 4 is now withdrawn from the fiber ends, keeping, however, its temperature constant (FIG. 13). Occasionally, after having withdrawn the stamp 4 at the temperature $T_1$, some material of the fibers still adheres to it. In order to remove this material, the stamp, in a fourth step, is heated to a second, higher temperature $T_2$ (FIG. 14) that is chosen such that in a pyrolysis process the material of the fibers first desintegrates into monomers before being vaporized. In this way, the stamp 4 is clean again and does not have any residual deposits. In the final step the stamp 4 is cooled to the temperature $T_1$ by directing compressed air against it (FIG. 15). Using fibers of polyamide, the temperature $T_1$ lies between 250° C. and 300° C. and the temperature $T_2$ between 600° C. and 700° C.

What is claimed:

1. A method of melting together axial ends of bunched fibers of thermoplastic material, comprising wherein said axial ends are brought into contact with a heated surface of a stamp, heating of said stamp being caused by passing a controlled electric current within the body of the stamp, cooling said stamp rapidly and separating the fiber ends from the surface of the stamp only after cooling of the surface has occurred.

2. The method according to claim 1, wherein the surface of the stamp is cooled by a flow of a cooling agent.

3. The method according to claim 1, wherein body said melting together axial ends of bunched fibers of thermoplastic material forms tufts of fiber for fabricating brushes and said axial ends of bunched filters are fiber ends to be attached to a brush body.

4. The method according to claim 3, wherein a plurality of tuft ends are simultaneously brought into contact with the surface of the stamp.

5. The method according to claim 4, wherein the tufts are inserted into through holes of a carrier plate and attached to said carrier plate by melting together adjacent tuft ends.

6. The method according to claim 5, wherein the through holes are enlarged on a side of the carrier plate where the tuft ends are melted together, and plasticized mass of fiber material is pressed into the enlargements of the through holes by pressing the heated surface of the stamp against the plasticized mass.

7. The method according to claim 6, wherein at least part of the plasticized mass is shaped into a continuous layer by pressing the heated surface of the stamp onto the mass.

8. A method of melting together axial ends of bunched fibers of thermoplastic material, comprising wherein said axial ends are brought into contact with a heated surface of a stamp, heating of said stamp being caused by passing a controlled electric current within the body of the stamp, wherein the electric current is controlled so that the stamp is heated alternately to a first temperature at which it is brought into contact with the fiber ends, and to a second, higher temperature at which fiber material adhering to the surface of the stamp is vaporized.

* * * * *